US005800051A

United States Patent [19]

Gampe et al.

[11] Patent Number: 5,800,051

[45] Date of Patent: Sep. 1, 1998

[54] MEDICAL LAMP WITH MULTI-COMPONENT PROJECTOR UNIT

[75] Inventors: Uwe Gampe, Floersheim; Rudolf Marka, Darmstadt; Stefan Greif, Fulda; Jörg Eduard Hartge, Gelnhausen, all of Germany

[73] Assignee: Heraeus Med GmbH, Hanau, Germany

[21] Appl. No.: 729,042

[22] Filed: Oct. 10, 1996

[30] Foreign Application Priority Data

Nov. 20, 1995 [DE] Germany ..... 195 43 006.9

[51] Int. Cl.[6] ..... F21V 7/00

[52] U.S. Cl. ..... 362/348; 362/347; 362/226; 362/247; 362/440

[58] Field of Search ..... 362/226, 247, 362/346, 347, 348, 457, 458, 440

[56] References Cited

U.S. PATENT DOCUMENTS

| | | | |
|---|---|---|---|
| 1,333,182 | 3/1920 | Minor et al. | 362/457 X |
| 3,511,983 | 5/1970 | Dorman . | |
| 5,072,348 | 12/1991 | Tsukada | 362/226 |
| 5,121,309 | 6/1992 | Ewing et al. | 362/226 |
| 5,186,535 | 2/1993 | Yokoyama | 362/226 |
| 5,513,082 | 4/1996 | Asano | 362/226 |
| 5,544,030 | 8/1996 | Wijibenga | 362/297 |

FOREIGN PATENT DOCUMENTS

| | | |
|---|---|---|
| 2 669 400 | 5/1992 | France . |
| 174393 | 2/1905 | Germany . |
| 1 061 900 | 7/1959 | Germany . |
| 1 489 495 | 4/1969 | Germany . |
| 1 472 529 | 7/1969 | Germany . |
| 89 12 262 | 1/1990 | Germany . |
| 93 09 559 | 1/1994 | Germany . |
| 2 066 443 | 7/1981 | United Kingdom . |

*Primary Examiner*—Ira S. Lazarus
*Assistant Examiner*—Nhat-Hang H. Lam
*Attorney, Agent, or Firm*—Frishauf, Holtz, Goodman, Langer & Chick, P.C.

[57] ABSTRACT

A medical lamp having a reflector in the shape of an ellipsoid of rotation containing on its interior side a plurality of facets which provide for a largely shadow-free illumination of the area to be lit. An opening is provided in the reflector, which is surrounded by a ring flange. A lamp having a spiral-wound filament therein is inserted into the ring flange so that its bulb is oriented towards the surface of the reflector where the light exits, whereby the spiral-wound filament in the bulb is positioned along the reflector axis. The bulb has a base with a cylindrical portion which is adjacent to a plate flange. The cylindrical portion of the base is encircled by the ring flange of the reflector opening in such a manner that the bulb is secured against shifting in the radial direction of the reflector axis. A clip attached to opposite ends of the reflector contacts the plate flange located at the rear end of the lamp in a locking manner to secure the base to the outer edge of the ring flange and, as a result, the lamp is set in its correct spiral-wound filament position. A major advantage of the present invention is its simple construction and the speed with which the lamp can be changed.

11 Claims, 3 Drawing Sheets

MEDICAL LAMP WITH MULTI-COMPONENT PROJECTOR UNIT

BACKGROUND OF THE INVENTION

1. Field of the Invention

The present invention pertains to a medical lamp with a projector unit comprising of at least one projector lamp and one reflector, whereby the reflector possesses a metallic or metalized surface.

2. Background Information

U.S. Pat. No. 3,511,983, the entire contents of which are hereby incorporated herein by reference, describes a lighting arrangement for dental and/or oral surgery applications. The lighting arrangement of U.S. Pat. No. 3,511,983 includes a reflector in the form of an ellipsoid of revolution which is provided along its rotational axis with a projector lamp located at the focal point. The reflector surface has a multitude of polygonal flutings whose reflecting surface are developed as a partial area of hollow cylinders. A spiral-wound filament, which is arranged along the rotational axis of the reflector, serves as a light source, whereby the spiral-wound filament is arranged with its center at the focal point of the reflector.

When changing the filament lamp in U.S. Pat. No. 3,511,983, the new adjustment of the spiral-wound filament is problematic since, in practice, it is extremely time-intensive and can be carried only out by specialist staff.

DE-GM 89 12 262 discloses a metal oxide vaporized mirror lamp, whose reflector has an opening for a lamp insert which, for purposes of a precise adjustment, features a lamp which is firmly anchored to the lamp insert with respect to the reflector. To secure its exact position and for the power supply, the lamp insert projecting into the opening of the reflector is connected in a detachable manner with a socket, which is arranged outside of the reflector, whereby an exact positioning of the filament lamp is achieved through a form-fit connection between lamp insert, reflector and socket.

DE-GM 89 12 62 is disadvantageous due to the relatively costly construction of the lamp insert and socket. Additionally, when changing the filament lamp in DE-GM 89 12 62, it is placeable only through the reflector opening, which is oriented towards the front, whereas the socket is accessible only via the rearward portion of the reflector, which increases mounting-related expenditures should a lamp change be required.

SUMMARY OF THE INVENTION

The present invention overcomes the aforesaid difficulties in the art.

An object of the present invention is to provide a medical lamp composed of as few components as possible in order to minimize inventory costs, while concomitantly ensuring an exact adjustment of a spiral-wound filament inside a reflector and permitting a lamp change without requiring special expert knowledge.

A further object of the present invention is to achieve a precise adjustment of the spiral-wound filament in the radial and axial direction of the reflector axis.

The present invention satisfies the above objects, as well as other objects, aims and advantages.

The present invention concerns a medical lamp with a projector unit comprising:

a reflector, the reflector having a front surface which is metallic or metalized and a rear surface, the reflector having an opening, a flange is disposed on the rear surface of the reflector and which surrounds the opening of the reflector; the flange projecting outwardly from the rear surface of the reflector;

at least one projector lamp disposed in the opening in the reflector, the at least one projector lamp having a bulb and a power supply line, the at least one projector lamp having a base which conforms to the cross-sectional area of the opening in the reflector, the base being adjacent at least partially to an inner surface of the flange, the base having an expanded surface at an end thereof opposite the bulb of the at least one projector lamp which projects radially outwardly and which rests at least partially on an outer edge of the flange, a passage being provided through the expanded surface through which passes the power supply line, and pl a clip which is attached at the ends thereof to the front surface of the reflector and which extends behind the rear surface of the reflector and is in pressure contact with an outer surface of the expanded surface of the base.

BRIEF DESCRIPTION OF THE DRAWINGS

For the purposes of illustrating the present invention there is shown in the drawings forms which are presently preferred. It is to be understood, however, that the present invention is not limited to the precise arrangements and instrumentalities depicted in the drawings.

FIG. 1 also shows a lamp for insertion during a lamp change.

DETAILED DESCRIPTION OF THE INVENTION

Figure 1:
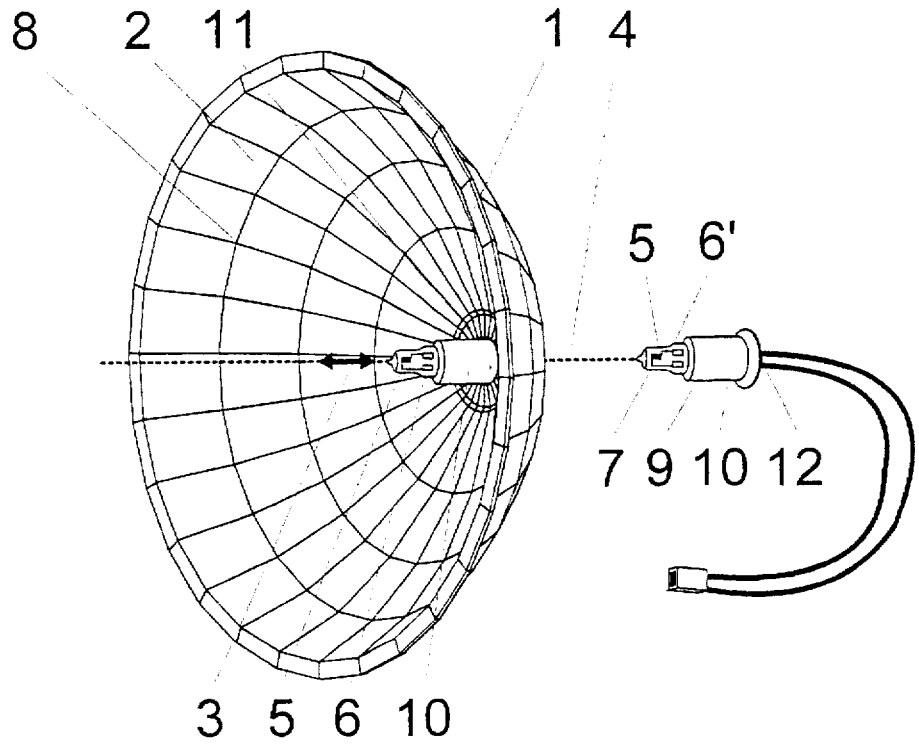
FIG. 1 is a perspective front view of a medical lamp of the present invention including a reflector with an inserted lamp.

With reference to the drawings, as shown in FIG. 1, the reflector 1 is substantially an ellipsoid of rotation in whose focal point area, which is schematically represented as zone 3 along a reflector axis 4, a spiral-wound filament 5 of a projector lamp 6 is located. The reflecting surface 2 of the reflector 1 includes a multitude of grooved flutings or facets 8, respectively, in a similar form as in U.S. Pat. No. 3,511,983. Due to the facets 8, a largely shadow-free and uniform illumination of the lit operating area or area to be lit is obtained, since each facet 8 illuminates virtually the entire operating area or area to be lit.

The projector lamp 6 or 6', respectively, comprising a bulb 7 and a base 9, is introduced (inserted) in the reflector 1 along an axis 4 into a circular opening 11 in the reflector 1 having a ring flange 13. The cylindrical portion 10 of the base 9, which is attached to the bulb 7 at one end thereof and has a plate flange 12 at an opposite end thereof which secures the inserted projector lamp 6 against shifting in the radial direction. In conjunction with the additionally represented projector lamp 6', such arrangement avoids axial shifting and tilting.

Figure 2:
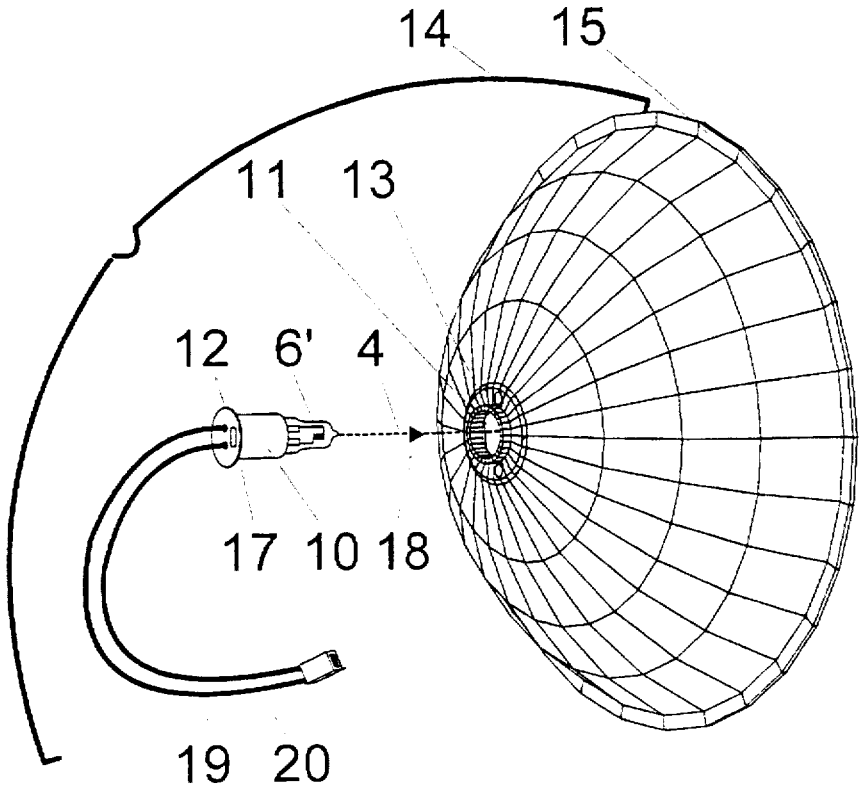
FIG. 2 is a rearside perspective view of the reflector together with a lamp for insertion therein.

As can be seen in FIG. 2, projector lamp 6' is introduced along the reflector axis 4 through the circular opening 11 of the reflector 1 in such a manner that the cylindrical portion 10 of the projector lamp 6' secures the projector lamp 6' against radial shifting by means of a ring flange 13 encircling circular opening 11 and against axial shifting and tilting by means of the plate flange 12 resting on the outer edge of the ring flange 13. An additional contact pressure element is provided in the form of a pressure clip 14 which engages with groove 17 on the rearside of the plate flange 12. By attaching the pressure clip 14 on the outer flange 15. of the reflector 1, the plate flange 12 is pressed against the ring flange 13, so that the projector lamp 6' is maintained in an adjusted position.

When there is burn-out of a projector lamp 6, which is disposed in reflector 1 according to FIG. 1, the projector lamp 6 is pulled out along the reflector axis 4 from the reflector opening 11 in the rearward direction of the reflector 1 and replaced with a projector lamp 6', along the axis 4 in the opening 11 of the reflector 1. The cylindrical portion 10 of the base 9 of the projector lamp 6' is pushed into the opening 11 encircled by the ring flange 13 along axis 4 until the plate flange 12 of the projector lamp 6 rests on the outer edge of the ring flange 13 and the projector lamp 6 is locked-in by means of the cylindrical portion 10 in the radial direction and by means of the plate flange 12 in the axial direction. By the aforementioned locking, the position of the spiral-wound filaments 5 inside the reflector 1 is also properly adjusted, since during the manufacture of the projector lamp 6, a bulb 7 with a spiral-wound filament 5 is already positioned in such a way with respect to the base 9 that a later precise adjustment is ensured through a simple exchange with the subsequent locking-in of the projector lamp 6.

As shown in FIG. 2, the insertion direction along arrow 18 parallel to reflector axis 4 can be seen, whereby the locking position is obtained through the resting of the plate flange 12 on the outer edge of the ring flange 13. The fixing in the locking position of the projector lamp 6 or 6', respectively, takes place through the pressure clip 14, which is held through two, diametrically-opposed detachable attachments in the area of the outer flange 15 of the reflector 1, whereby pressure is exerted onto groove 17 provided in plate flange 12. The power supply lines 19, 20, which extend from plate flange 12 and are insulated against each other, are connected to a power supply (not shown) for the medical lamp after the lamp insertion procedure. However, it is also possible to supply the lamp with power via plug-in connections.

Figure 3A:
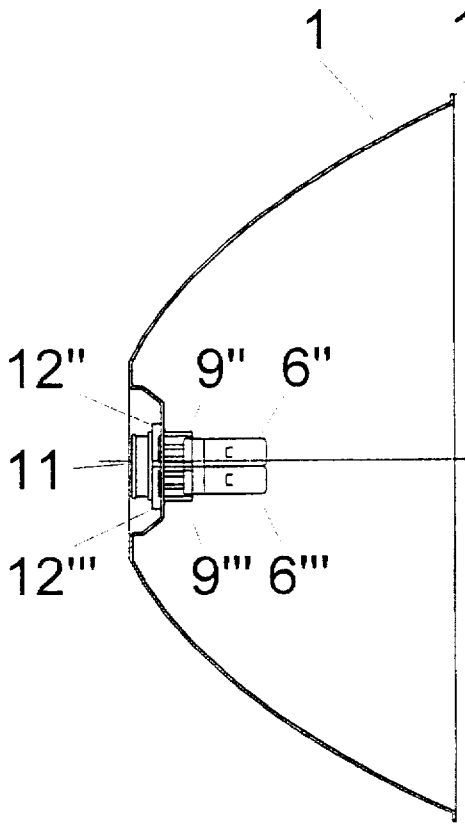
FIG. 3*a* is a sectional view showing two lamps arranged inside the reflector with the radiation axes parallel to each other.

In an additional embodiment of the present invention as shown in FIG. 3*a*, the opening 11 provided for the projector lamp 6 to be inserted has an oval shape, whereby the flange 13 surrounding the opening 11 also has an oval cross-section. Into the opening 11 two projector lamps 6", 6''', whose longitudinal axes are oriented parallel to each other, can be inserted. The respective bases 9", 9''' of the projector lamps 6", 6''' each has a semi-oval cross-section, whereby the two bases 9", 9''' together form a complete oval when inserted into the reflector 1. The outer contour of the two bases 9", 9''' is matched to the inner surface of the flange 13, which provides an arrangement which is free from play.

Figure 3B:
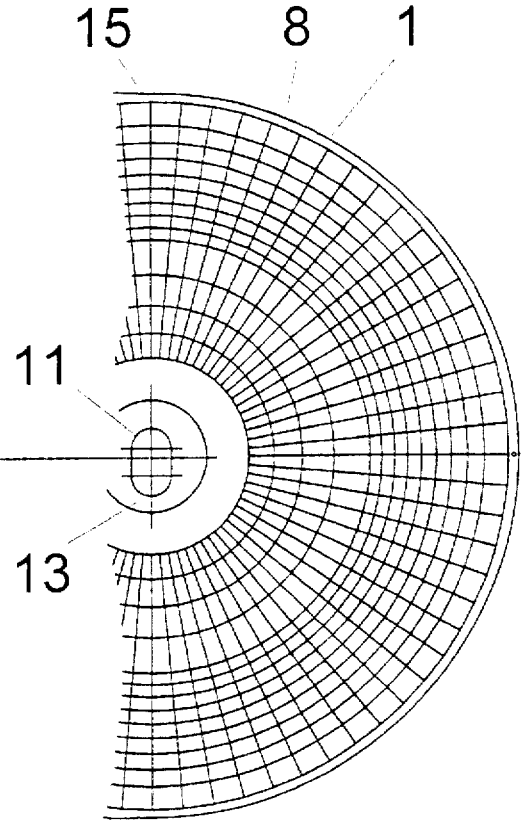
FIG. 3*b* is a partial front elevational view showing half of a parabolic reflector according to FIG. 3*a*, wherein a multitude of facets are represented in the form of a grid.

The oval shape can also be seen in FIG. 3*b* with respect of oval opening 11 inside the reflector 1, which reflector 1 is provided with a multitude of facets 8.

Figure 3C:
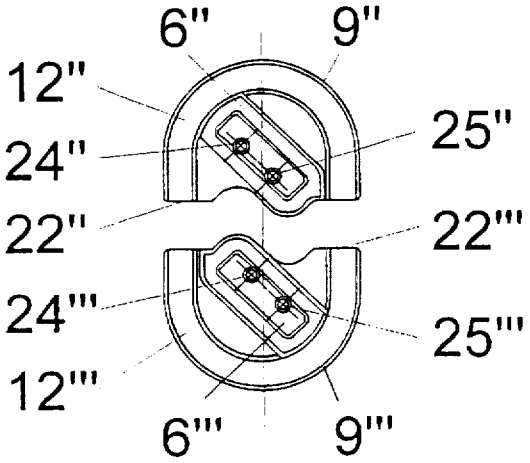
FIG. 3*c* is a plan view showing the contact surfaces of two separate lamp bases which are congruent with respect to each other.
Figure 3D:
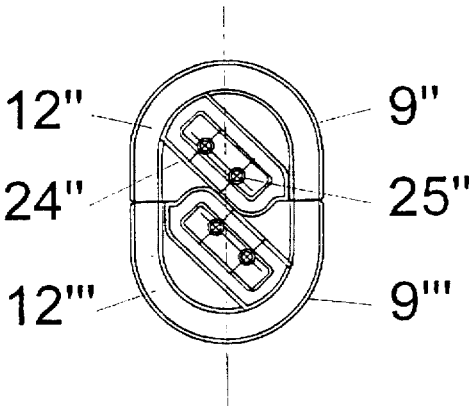
FIG. 3*d* is a plan view of the two lamp bases shown in FIG. 3*c*, which are adjacent to each other after being inserted in the ring flange of the reflector.
Figure 4A:
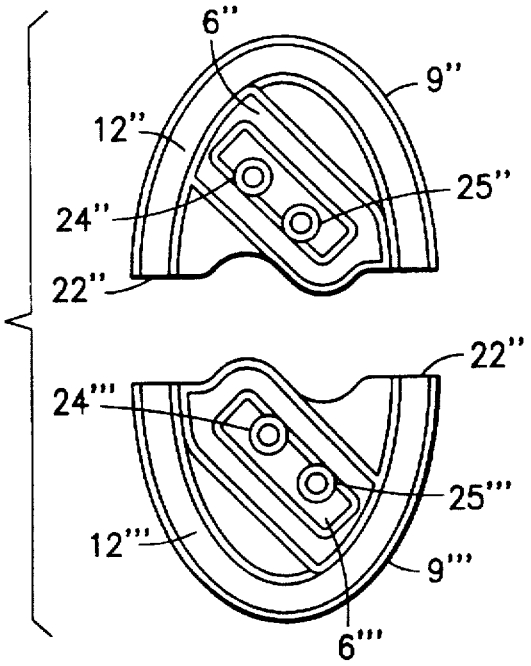
FIG. 4*a* is a plan view showing two lamp bases in a separated condition for insertion into an elliptical flange.
Figure 4B:
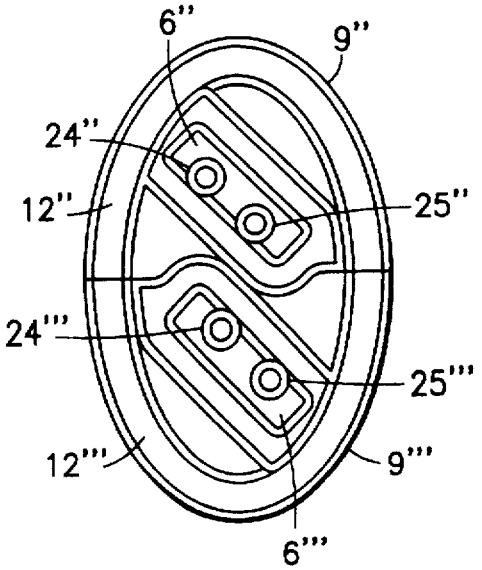
FIG. 4*b* is a plan view of the two lamp bases shown in FIG. 4*a* in a connected condition for insertion into an elliptical flange.
Figure 5A:
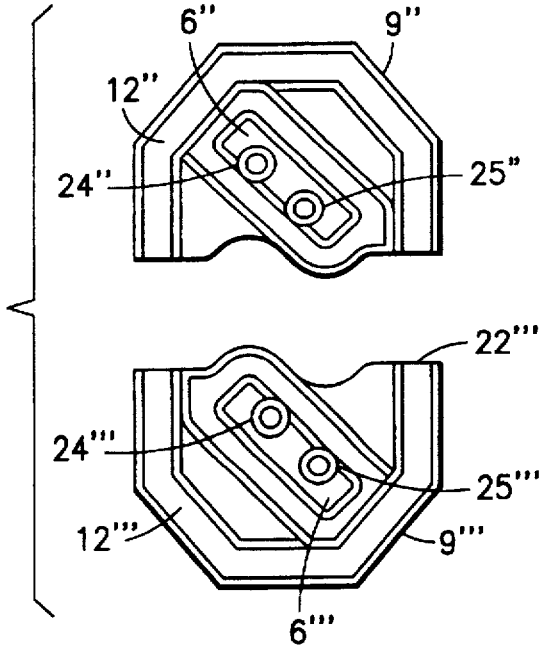
FIG. 5*a* is a plan view showing two lamp bases in a separated condition, for insertion into a polygonal flange.
Figure 5B:
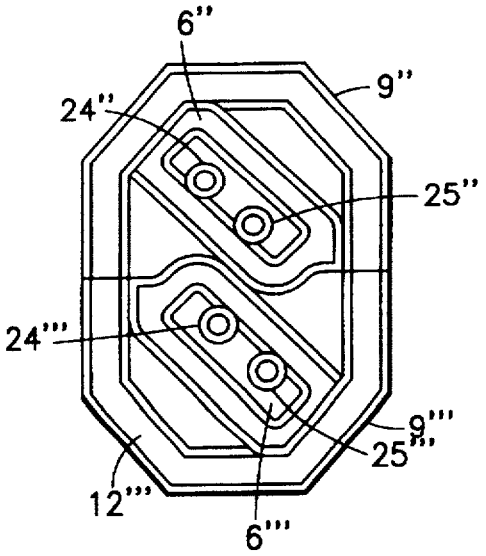
FIG. 5*b* is a plan view of the two lamp bases shown in FIG. 5*a* in a connected condition for insertion into a polygonal flange.

A correspondingly conforming cross-sectional surface is shown in FIGS. 3*c* and 3*d*, whereby both bases 9", 9''' essentially engage each other in the area of their supporting surfaces 22", 22''', respectively, which face each other, whereas their outer surfaces are connected with an outer encircling plate flange 12", 12'. When joining the originally spatially separated bases 9", 9''' (as shown in FIG. 3*c*) to form a two-part base according to FIG. 3*d*, the heretofore partially encircling flange areas 12", 12''' form a closed, encircling plate flange. The contacting of the projector lamps 6", 6''' takes place via the outer contact pins 24", 25", 24''', 25'''.

The coupling of bases 9", 9''' in the above-described fashion corresponds in its locking function to the embodiment shown in FIGS. 1 and 2.

In a preferred embodiment of the present invention, the lamp base is, like the flange, cylindrically shaped and has a plate flange at the end facing away from the bulb, so that through the cylindrical area a precise adjustment in the radial direction is ensured and through the plate flange a precise adjustment in the axial direction is obtained.

In another preferred embodiment of the present invention, the reflector is made of aluminum, which affords favorable deforming properties when manufacturing the blank and easy coating of the reflecting surface. A ceramic is preferably used for the lamp base, as a thermally stable and electrically insulating material.

A particular advantage of the present invention is its simple and sturdy construction, whereby, through the particular design of the projector lamp, undesired contact with the bulb surface is avoided due to the lamp base which can be used as a handle.

Another advantage of the present invention is that a twisting of the lamp around its longitudinal axis is prevented.

A further advantageous feature of the present invention is the ease and safety for replacing a lamp, that is especially important for medical lamps.

It will be appreciated that the instant specification is set forth by way of illustration and not limitation, and that various modifications and changes may be made without departing from the spirit and scope of the present invention.

What is claimed is:

1. A medical lamp with a projector unit comprising:

a reflector, the reflector having a front surface which is metallic or metalized and a rear surface, the reflector having an opening, a flange is disposed on the rear surface of the reflector and which surrounds the opening in the reflector, the flange projecting outwardly from the rear surface of the reflector;

a first projector lamp and a second projector lamp which are both disposed in the opening in the reflector, each of the first and second projector lamps having a bulb and a power supply line, the first projector lamp having a first base and the second projection lamp having a second base, wherein the first base and the second base are joined together to form a closed cross-sectional surface whose outer contour conforms to the inner contour of the flange, the first and second bases being adjacent at least partially to an inner surface of the flange, the first and second bases each having an expanded surface at an end thereof opposite the bulbs of each of the first and second projector lamps, the expanded surface of each of the first and second bases projects radially outwardly and rests at least partially on an outer edge of the flange, a passage being provided through the expanded surface of each of the first and second bases through which passes the power supply line, and a clip which is attached at the ends thereof to the front surface of the reflector and which extends behind the rear surface of the reflector and is in pressure contact with an outer surface of the expanded surface of each of the first and second bases.

2. The lamp according to claim 1, wherein the base consists essentially of a thermally stable, electrically insulating material.

3. The lamp according to claim 1, wherein the reflector consists essentially of aluminum.

4. The lamp according to claim 1, wherein the flange is in a tubular form.

5. The lamp according to claim 4, wherein the flange has a substantially oval-shaped cross-section.

6. The lamp according to claim 4, wherein the flange has a substantially elliptical shaped cross-section.

7. The lamp according to claim 4, wherein the flange has a substantially polygonal shaped cross-section.

8. The lamp according to claim 1, wherein the cross-section of the outer surface of the lamp base conforms to the cross-section of the flange.

9. The lamp according to claim 1, wherein the flange is substantially centrally disposed in the reflector.

10. The lamp according to claim 9, wherein the reflector is in the shape of an ellipsoid.

11. The lamp according to claim 10, wherein the inner surface of the reflector has a plurality of facets.

* * * * *